US005454145A

United States Patent [19]

Wattel et al.

[11] Patent Number: 5,454,145

[45] Date of Patent: Oct. 3, 1995

[54] METHOD FOR MANUFACTURING A NONWOVEN PRODUCT, A NONWOVEN PRODUCT OBTAINED IN PARTICULAR BY SAID METHOD AND AN INSTALLATION FOR THE MANUFACTURE OF SAID NONWOVEN PRODUCT

[75] Inventors: Jean-René Wattel; Jean-Christophe Laune; Bernard Jourde, all of Elbeuf, France

[73] Assignee: Asselin (Societe Anonyme), Elbeuf, France

[21] Appl. No.: 977,408

[22] PCT Filed: Jun. 19, 1992

[86] PCT No.: PCT/FR92/00566

§ 371 Date: Mar. 1, 1993

§ 102(e) Date: Mar. 1, 1993

[87] PCT Pub. No.: WO93/00456

PCT Pub. Date: Jan. 7, 1993

[30] Foreign Application Priority Data

Jun. 28, 1991 [FR] France ..... 91 08050

[51] Int. Cl.[6] ..... D01G 25/00

[52] U.S. Cl. ..... 19/163; 28/101

[58] Field of Search ..... 19/163, 161.1, 19/296; 28/101, 102, 100

[56] References Cited

U.S. PATENT DOCUMENTS

| | | | |
|---|---|---|---|
| 1,733,170 | 10/1929 | Robertson et al. . | |
| 1,999,169 | 4/1935 | Jackson | 19/163 |
| 2,927,350 | 3/1960 | Nelson | 19/163 |
| 3,183,557 | 5/1965 | Hollowell . | |
| 3,660,868 | 5/1972 | Weightman | 19/163 |
| 3,682,734 | 8/1972 | Burger | 19/163 |
| 5,182,835 | 2/1993 | de 'Giudici | 19/163 |

FOREIGN PATENT DOCUMENTS

| | | |
|---|---|---|
| 0129516 | 12/1984 | European Pat. Off. . |
| 1045194 | 11/1953 | France . |

*Primary Examiner*—C. D. Crowder
*Assistant Examiner*—Amy B. Vanatta
*Attorney, Agent, or Firm*—Young & Thompson

[57] ABSTRACT

A high-quality nonwoven product is manufactured by making use of an intermediate product in which the majority of fibers are distributed in two orientations which form an angle with each other. The intermediate product is fed to a spreading and lap-forming machine (13A, 13B) which deposits the intermediate product in alternate pleats on its delivery belt so as to form a lap of superposed layers such that the majority orientations of the fibers within each layer form an angle with the majority orientations of the fibers of the contiguous layers, and the lap is subjected to a fixing treatment, for example by means of a needle-punching machine (14A, 14B).

12 Claims, 3 Drawing Sheets

METHOD FOR MANUFACTURING A NONWOVEN PRODUCT, A NONWOVEN PRODUCT OBTAINED IN PARTICULAR BY SAID METHOD AND AN INSTALLATION FOR THE MANUFACTURE OF SAID NONWOVEN PRODUCT

The present invention relates to a method for manufacturing nonwoven products.

This invention also relates to a nonwoven product which can be obtained by this method.

The present invention is also concerned with an installation for the manufacture of said nonwoven product.

It is known to manufacture nonwoven fabrics by producing a web of longitudinal parallel fibers, the web being fed to a spreading and lap-forming machine which forms a lap by depositing said web in successive pleats which overlap in a zigzag pattern on a delivery belt, the belt being so arranged as to move at right angles to the direction of feed of the web.

The lap thus obtained has two "privileged" orientations of the fibers which correspond to the orientations of the fibers present in superposed web sections in the lap. These two privileged orientations are usually symmetrical with respect to the transverse direction of the delivery belt and relatively close to this transverse direction.

As a rule, the fibers are then fixed to each other, for example by means of a needle-punching operation which interlaces the fibers having different orientations.

There is thus obtained a product having poor uniformity of weight, low tensile strength in the longitudinal direction since the fibers are essentially directed transversely, and high shrinkage in width at the time of needle-punching since this operation calls for the application of a pulling stress in the longitudinal direction at the exit of the needle-punching unit.

It is also known to pass fibers successively into two paired units each consisting of a card and a spreading and lap-forming machine. This is simply intended to achieve better mixing of fibers which are different in nature or color but fails to solve the difficulties mentioned earlier.

The object of the present invention is to overcome these difficulties.

In accordance with a first object of the invention, the method for manufacturing a nonwoven product is distinguished by the fact that it involves the use of an intermediate product in which the majority of the fibers present therein are distributed in two orientations which form an angle with each other, and that this intermediate product is fed to a spreading and lap-forming unit which deposits the intermediate product in alternate pleats on its delivery belt so as to form a lap of superposed layers such that the majority orientations of the fibers in each layer form an angle with the majority orientations of the fibers of the contiguous layers, and the lap is subjected to a fixing treatment, for example by needle-punching.

Thus the fibers are distributed in four different orientations within the lapped product which is accordingly endowed with very good uniformity and very high tensile strength in all directions. This is advantageous not only for subsequent treatment but also for the mechanical properties of the final product to be obtained.

In accordance with a second object of the invention, the nonwoven product is distinguished by the fact that the majority of the fibers in said product are distributed in four privileged orientations.

In accordance with a third object of the invention, the installation for the manufacture of a nonwoven product is distinguished by the fact that it comprises in series, in this order, a card, a first spreading and lap-forming unit, a drawing frame and a second spreading and lap-forming unit.

Other features and advantages of the invention will appear from the following description, taken in connection with non-limiting examples.

Figure 1:
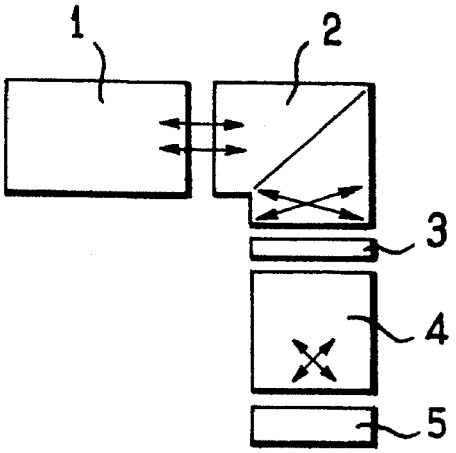
FIG. 1 is a schematic view of an installation for manufacturing an intermediate product which can be employed in the method in accordance with the invention.
Figure 9:
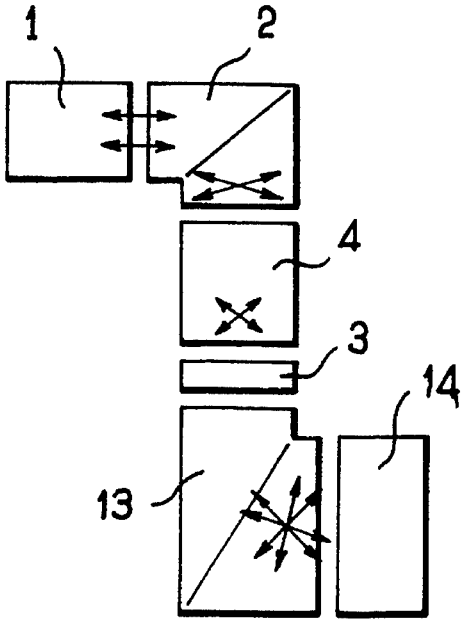
FIGS. 8 and 9 are schematic views of installations for the manufacture of a finished nonwoven product in accordance with the invention.
Figure 8:
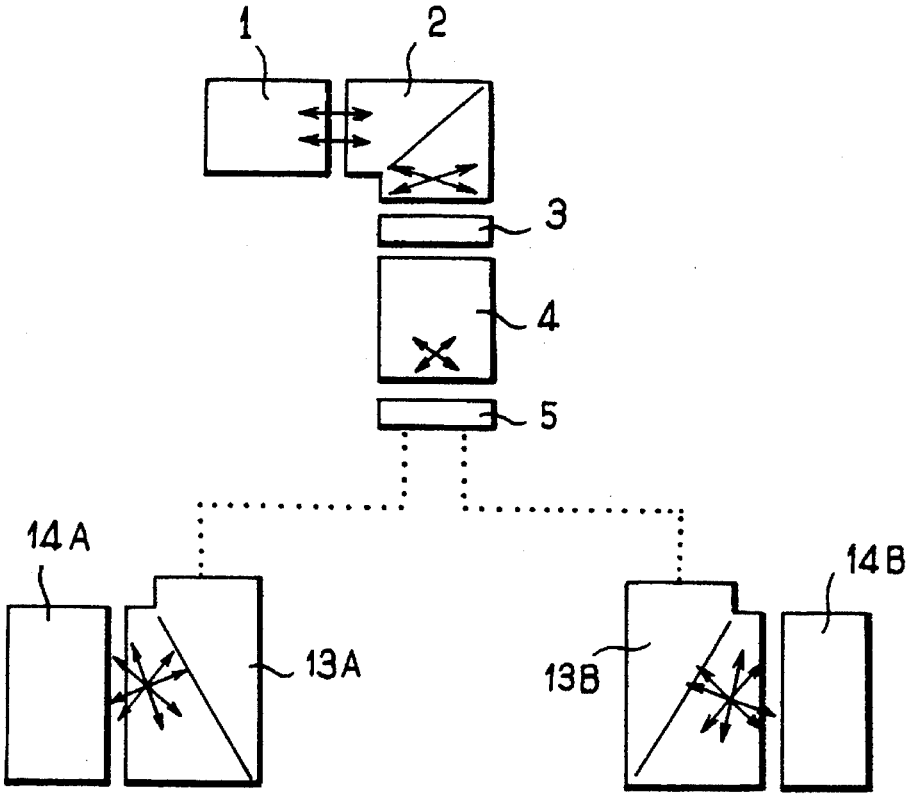

An intermediate product employed in the present invention can be obtained by means of the installation shown in FIG. 1 which can form part of a longer production line as indicated in FIGS. 8 and 9. This installation comprises, in series, a card 1, a spreading and lap-forming unit 2, a selvedge-teaser 3, a lap-drawing unit 4, and a roller 5 which collects the semifinished product.

Figures 4, 5, 6, 7:
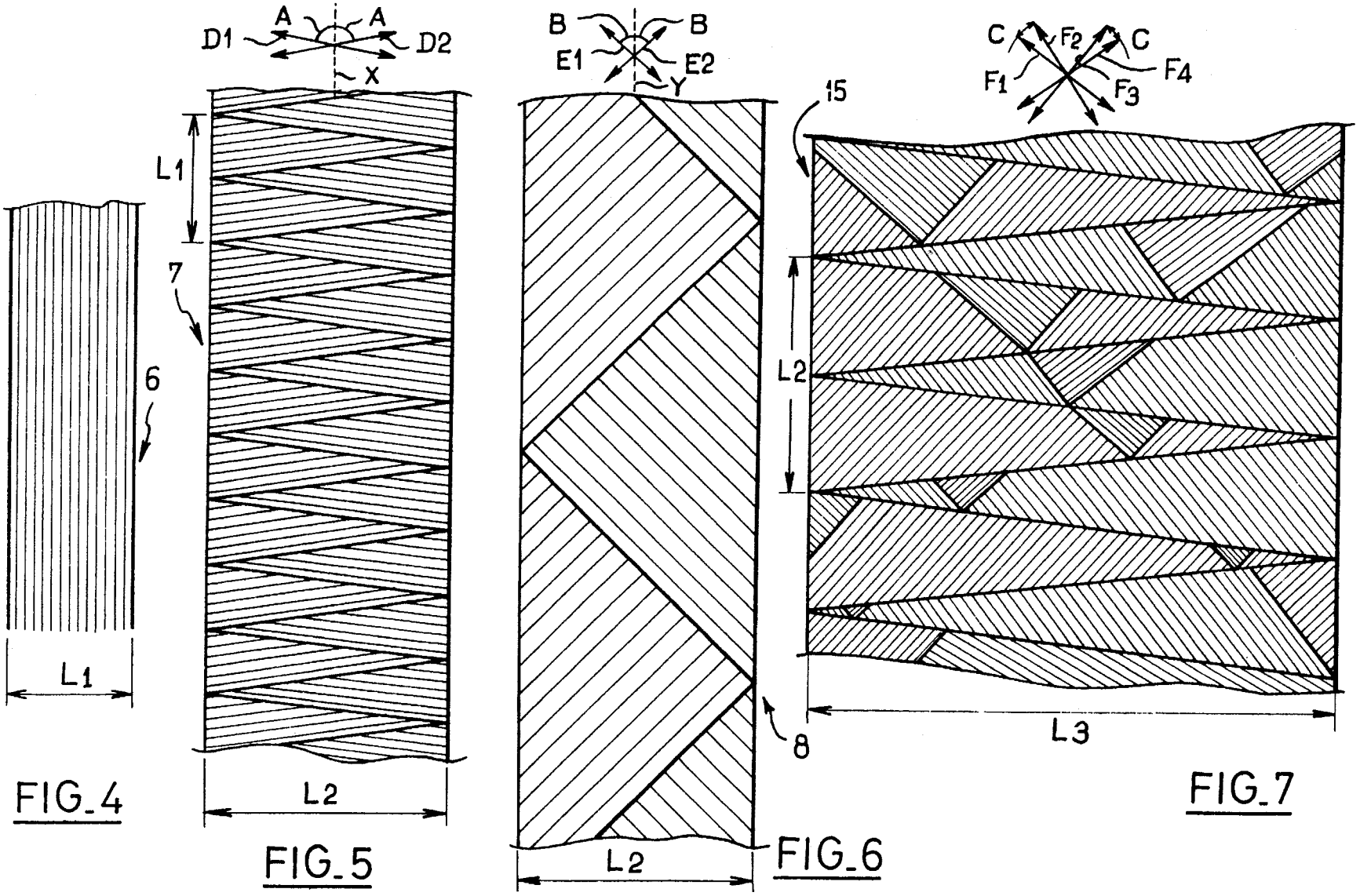
FIGS. 4 to 7 are schematic views showing the privileged orientations of the fibers in the textile product at different stages of manufacture.

The card 1 produces a web of fibers 6 having a width L1 (as shown in FIG. 4). The fibers of the web 6 are essentially oriented in a direction which is substantially parallel to the longitudinal direction of the web 6.

The spreading and lap-forming unit 2 is supplied with said web 6 which is delivered by the card 1. As shown in FIG. 5, a lap 7 is formed in known manner by the spreading and lap-forming unit 2 by successively folding the web 6. Said lap 7 is made up of superposed sections of web delimited by alternate pleats which define the lateral edges of the lap 7. These alternate pleats are relatively displaced in a direction parallel to the longitudinal direction X of the lap 7, with the result that the majority of the fibers in the lap 7 are distributed in two orientations D1, D2 which are symmetrical with respect to the longitudinal direction X of the lap 7. These majority orientations D1, D2 in the lap 7 form with its longitudinal direction X an angle A which is smaller than 90° and usually fairly close to this value (typically $75° < A < 90°$). This angle A can be chosen in a known manner by adapting the adjustments of the spreading and lap-forming unit 2. In the example illustrated in FIGS. 4 and 5, the spreading and lap-forming machine 2 has been so adjusted that the lap 7 has four layers of web 6. Thus the successive pleats located on one and the same lateral edge of the lap 7 are relatively displaced by one-half the width L1 of the web 6 delivered by the card 1.

At the exit of the spreading and lap-forming unit 2, the lap 7 passes into a selvedge-teaser 3 which teases the lateral edges of the lap 7 in known manner.

Figure 2:
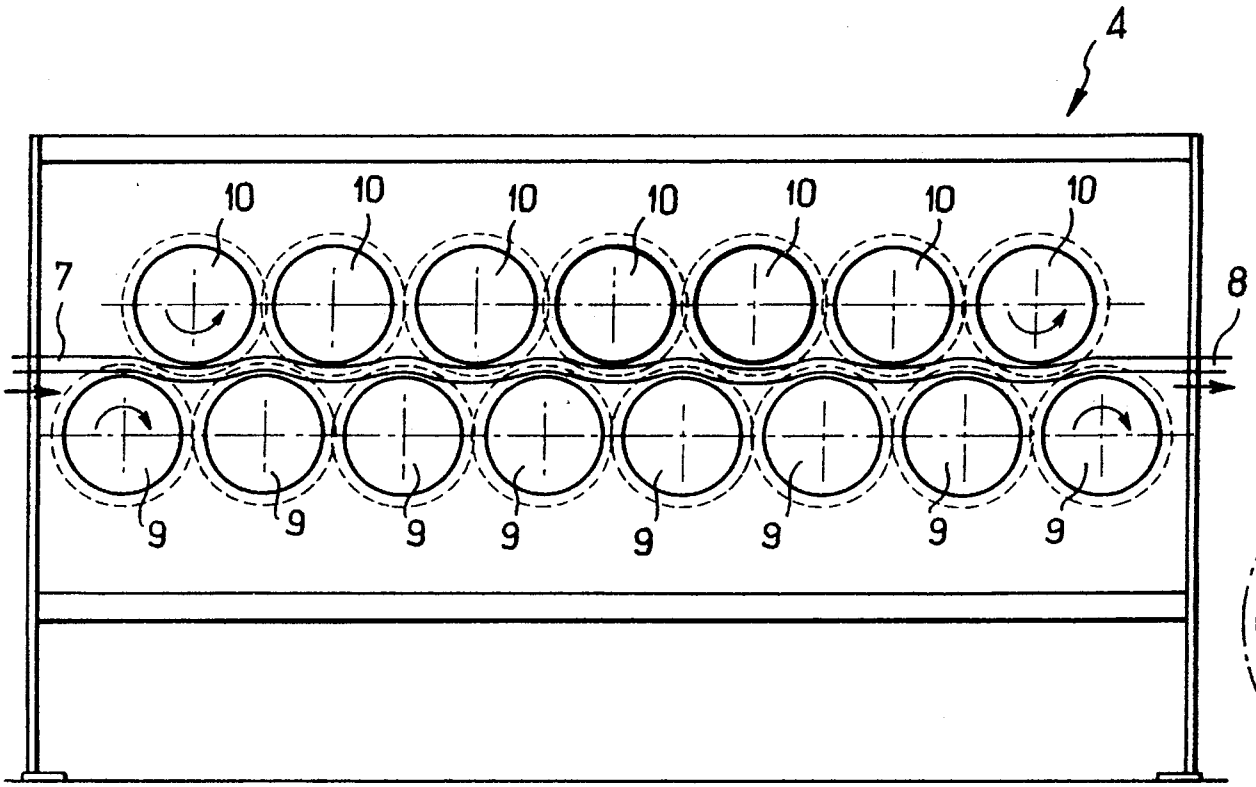
FIG. 2 is a schematic view in elevation showing the interior of a drawing frame which forms part of the installation of FIG. 1.

At the exit of the selvedge-teaser 3, the lap 7 is introduced into the drawing frame 4, the exit end of which delivers the intermediate product 8 (FIG. 6). As shown in FIG. 2, the lap-drawing frame 4 has rotating rollers 9, 10 disposed successively along the path of transfer of the lap during the drawing operation. These rollers 9, 10 are placed alternately above and beneath the lap which is being drawn-out. Said rollers 9, 10 are driven in rotation so as to cause the lap to advance along the drawing frame 4. Each roller 9, 10 is driven in rotation at a speed equal to or higher than that of the preceding roller along the path of travel of the lap. By adjusting the difference in speed between the successive rollers 9, 10 (typically between 0 and 100%), one adjusts the degree of draft of the lap 7 within the drawing frame 4. The number of rollers 9, 10 can vary from five to thirty. The total degree of draft can amount to 800%.

Figure 3:
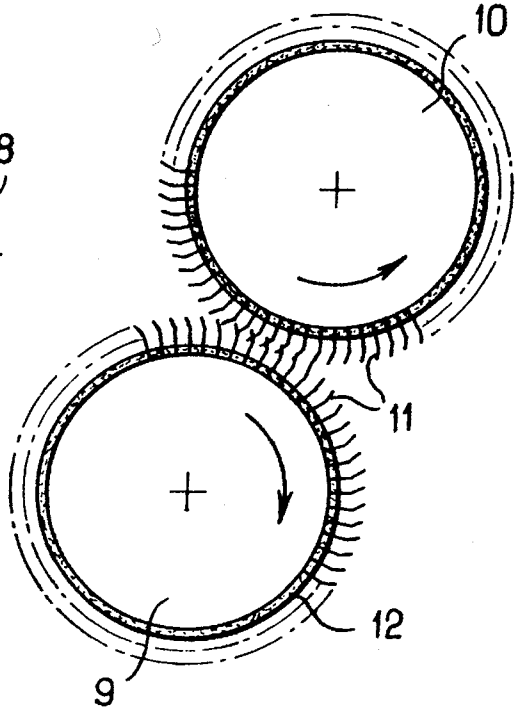
FIG. 3 shows in elevation a detail of FIG. 2.

With reference to FIG. 3, it is seen that the rollers 9, 10 are provided at their periphery with a covering in which are set teeth 11. The teeth 11 of the covering are flexible. To this end, they can be in the form of wire teeth fixed on a textile base 12 which surrounds the roller 9, 10. In the example shown in FIG. 3, the flexible teeth 11 extend in a substantially radial direction with respect to the rollers 9, 10 and have an end portion which is elbowed (at an angle of 10°, for example) towards the rear with respect to the direction of rotation of the roller 9, 10. The teeth 11 carried by two successive rollers 9, 10 interpenetrate to a certain length so that, when the lap travels between these two successive rollers, the teeth 11 penetrate to the heart of the lap.

The majority orientations (E1, E2) of the fibers which constitute the intermediate product 8 are shown diagrammatically in FIG. 6. The orientations of the fibers in the product 8 have been modified by the drawing operation and the fibers issuing from contiguous sections of web of the non-drawn lap 7 have to some extent been interlocked as a result of penetration of the teeth 11 into the heart of the lap during the drawing operation. FIG. 6 illustrates the product 8 made up of successive inclined sections of web but it will be observed that, for the sake of enhanced clarity of the figure, this schematic illustration exaggerates the sharpness of outline of the structure of the product 8 which is homogenized by the interengagement of the fibers. Owing to the structure of the covering of the rollers 9, 10 of the drawing frame 4, the lap is subjected to very slight transverse shrinkage during the drawing operation, with the result that the width L2 of the drawn intermediate product 8 is substantially equal to that of the lap 7 prior to drawing. The degree of draft within the drawing frame 4 is so adjusted that the fibers within the drawn intermediate product 8 are for the most part distributed in two orientations E1, E2 which are substantially symmetrical with respect to the longitudinal direction Y of the drawn product 8 and form with this direction an angle B within the range of 30° to 60°. In the example illustrated in FIG. 6, the drawing frame 4 has been so adjusted that said angle B is approximately 45°, which represents a preferred value for optimizing the homogeneity of the product.

The semifinished product 8 thus obtained has a resistance in the longitudinal direction which is of the same order of magnitude as the resistance to pulling stress in the transverse direction. If the drawing frame 4 is so adjusted that the degree of draft is increased in order to obtain an angle B of less than 45° between the majority orientations E1, E2 and the longitudinal direction Y, it is possible to obtain a product having a resistance to pulling stress (tensile strength) which is higher in the longitudinal direction Y than in the transverse direction.

The semifinished product 8 has sufficient cohesion to be coiled directly on a roller 5 as it passes out of the drawing frame 4. The semifinished product 8 can thus advantageously be stored in a coiled form.

At the exit of the drawing frame 4, the drawn product 8 can also be subjected to a treatment by heat-setting, water jet, impregnation, needle-punching, incorporation of a chemical binder, spraying, ultrasonic treatment, tufting or sewing of fibers.

The semifinished product 8 advantageously has a weight per unit area which is lower than 50 g/m$^2$ and preferably lower than 30 g/m$^2$. It is possible for example to obtain a semifinished product 8 having a weight per unit area of 20 g/m$^2$ starting from a web 6 of 30 g/m$^2$ folded to four thicknesses so as to form a lap 7 of 120 g/m$^2$ prior to drawing.

In accordance with the invention, an intermediate product such as the semifinished product 8 is employed for the purpose of manufacturing a nonwoven fabric which has remarkable mechanical properties. An installation in a non-continuous line which is suitable for this application is shown diagrammatically in FIG. 8, in which the references 1 to 5 correspond to the arrangement of machines (as shown in FIG. 1) for the purpose of obtaining the intermediate product. In this installation, the uncoiled semifinished product 8 is introduced into a second spreading and lap-forming unit 13A, 13B so as to form a second lap 15 by folding (as shown in FIG. 7). The second spreading and lap-forming unit 13A, 13B deposits the intermediate product 8 in alternate pleats on its delivery belt so as to form a second lap 15 of superposed layers such that the majority orientations of the fibers in each layer form an angle with the majority orientations of the fibers of the contiguous layers. Typically, the second spreading and lap-forming unit 13A, 13B is so arranged as to produce at its exit a second lap 15, the width L3 of which is greater than the width L2 of the semifinished product 8, and the weight per unit area of which is at least equal to twice that of the semifinished product 8. It is apparent from FIG. 7 that the majority of the fibers constituting the second lap 15 are distributed in four distinct orientations F1, F2, F3, F4, thus endowing the second lap 15 with excellent properties of isotropy. The two majority orientations F1, F3 in each of the alternate web sections constituting the second lap 15 correspond to the majority orientations E1, E2 of the fibers in the intermediate product 8 prior to folding. The majority orientations F1, F3 of the fibers in each layer form an angle C with the majority orientations F2, F4 of the fibers of the contiguous layers. Said angle C can be selected by adjusting the second spreading and lap-forming unit 13A, 13B in regard to the relative longitudinal displacement between two successive pleats along one and the same edge and the working width.

At the exit of the second spreading and lap-forming unit 13A, 13B, the second lap 15 is subjected to a fixing treatment, for example by means of a needle-punching machine 14A, 14B. The needle-punched nonwoven product obtained at the exit of the needle-punching unit 14A, 14B has fibers distributed for the most part in the four privileged orientations F1, F2, F3, F4 of the second lap 15. This product has values of breaking strength and of elongation at rupture which can be adjusted by adapting the number of pleats made in the second spreading and lap-forming unit 13A, 13B, these values being substantially equal to each other in the longitudinal and transverse directions of the nonwoven product.

Since the intermediate product 8 is passed through a selvedge-teasing unit 3 prior to drawing, the lateral edges of the intermediate product 8 are practically invisible on the final needle-punched nonwoven product.

It is apparent from FIG. 8 that two groups 13A, 14A and 13B, 14B each consisting of a spreading and lap-forming machine and a needle-punching machine are mounted downstream of the same drawing frame 4. The object of this arrangement is to optimize the use of these machines since the output of the drawing frame 4 is usually higher than the input of a spreading and lap-forming machine 13A, 13B. This advantageous arrangement can be obtained by virtue of the fact that the intermediate product 8 can be coiled at the exit of the drawing frame 4, then uncoiled at the entrance of one of the spreading and lap-forming units 13A, 13B.

As will be readily understood, if the above-mentioned input and output are adjusted so as to be relatively close in value, a single group formed by a spreading and lap-forming machine and a needle-punching machine can be mounted directly at the exit of the drawing frame 4 and the storage roller 5 may accordingly be dispensed with.

This installation operates in a continuous production line and is illustrated diagrammatically in FIG. 9. Three main differences distinguish this installation from that illustrated in FIG. 8:

1) a single group consisting of a spreading and lap-forming machine and a needle-punching machine 13, 14 is mounted downstream of the drawing frame 4;
2) the storage roller 5 is dispensed with and the spreading and lap-forming unit 13 is directly supplied with intermediate product;
3) the positions of the drawing frame 4 and of the selvedge-teasing unit 3 are reversed (as a rule, the selvedge-teaser 3 can be placed indifferently upstream or downstream of the drawing frame 4, the purpose of this unit being to prevent the edges of the intermediate product from appearing on the final nonwoven product).

It will therefore be understood that the method in accordance with the invention can be carried out either non-continuously by means of an installation as illustrated in FIG. 8, in which case the intermediate product 8 is temporarily stored after drawing, or continuously by means of an installation as illustrated in FIG. 9, in which case the intermediate product 8 has only a brief existence, between the exit of the drawing frame 4 and the entrance of the spreading and lap-forming unit 13, thus avoiding any risk of modification of its properties during storage.

As will be readily understood, any number of modifications can be made in the particular examples described in the foregoing without thereby departing from the scope of the present invention.

We claim:

1. A method of manufacturing a nonwoven product from a semifinished nonwoven product (8), comprising providing discontinuous fibers to a card (1);

producing a carded web (6) from said fibers;

delivering said web (6) from the card (1) in a longitudinal direction with the majority of the discontinuous fibers within the web (6) distributed in a direction parallel to said longitudinal direction;

feeding said web (6) to a cross-lapping unit (2);

folding the web (6) into the cross-lapping unit (2) so as to obtain a batt (7) having a selected width (L2) as measured perpendicularly to said longitudinal direction (Y) and including a selected number of layers from the cross-lapped web (6), the majority of the discontinuous fibers in the batt (7) being distributed in two directions (D1; D2) that are symmetrical and are oriented at a first angle (A) comprised between 75° and 90° to a longitudinal direction (X) of the batt (7) delivered by the cross-lapping unit (2);

feeding the batt (7) to a drawing frame (4) including two series of rollers (9, 10) rotated with an increasing velocity in the longitudinal direction and each covered with flexibly mounted needle-like teeth (11), the teeth (11) of said series of rollers (9, 10) radially interfingering with each other;

passing the batt (7) between the rollers in such a manner that the teeth (11) of the rollers penetrate the batt (7) which is thus drawn to obtain a semifinished nonwoven product (8), the degree of drawing being such that over the whole thickness of the product (8) the majority of the discontinuous fibers are pivoted about the teeth (11) in such a manner that said first angle (A) is changed to a second angle (B) comprised between 30° and 60° to the longitudinal direction (Y) of the two symmetrical directions (E1; E2) of the majority of the discontinuous fibers in the drawn product (8); said second angle (B) being such as to obtain a predetermined resistance to pulling stress of the drawn product (8); and a width (L2) of the product (8) as measured perpendicular to the longitudinal direction (Y) is substantially equal to the corresponding width (L2) of the batt (7) before drawing;

feeding said semifinished intermediate product (8) to a spreading and lap-forming unit (13; 13A; 13B) which deposits the semifinished product (8) in alternate pleats on a delivery belt of the lap-forming unit, so as to form a lap (15) of superposed layers such that the majority of the discontinuous fibers in each layer are distributed in orientations (F1; F3) forming an angle (C) with the orientations (F2; F4) of the majority of the fibers in the contiguous layers; and subjecting the lap (15) subsequently to a fixing treatment in order to obtain a nonwoven product presenting four different orientations (F1; F2; F3; F4) of the majority of the discontinuous fibers.

2. A method as claimed in claim 1, wherein said second angle (b) is about 45°.

3. A method as claimed in claim 1, wherein said batt (7) is comprised of four layers of web.

4. A method as claimed in claim 1, and subjecting the edges of said batt (7) to teasing.

5. A method as claimed in claim 1, and coiling said semifinished woven product (8), and then uncoiling said semifinished unwoven product (11) prior to feeding the same to said lap forming unit (13; 13A; 13B).

6. A method as claimed in claim 1, wherein said fixing treatment is needle punching.

7. An installation for manufacturing a nonwoven product from a semifinished nonwoven product (8), comprising means for providing discontinuous fibers to a card (i);

means for producing a carded web (6) from said fibers;

means for delivering said web (6) from the card (1) in a longitudinal direction with the majority of the discontinuous fibers within the web (6) distributed in a direction parallel to said longitudinal direction;

means for feeding said web (6) to a cross-lapping unit (2);

means for folding the web (6) into the cross-lapping unit (2) so as to obtain a batt (7) having a selected width (L2) as measured perpendicularly to said longitudinal direction (Y) and including a selected number of layers from the cross-lapped web (6), the majority of the discontinuous fibers in the batt (7) being distributed in two directions (D1; D2) that are symmetrical and are oriented at a first angle (A) comprised between 75° and 90° to a longitudinal direction (X) of the batt (7) delivered by the cross-lapping unit (2);

means for feeding the batt (7) to a drawing frame (4) including two series of rollers (9, 10) rotated with an increasing velocity in the longitudinal direction and each covered with flexibly mounted needle-like teeth (11), the teeth (11) of said series of rollers (9, 10) radially interfingering with each other;

means for passing the batt (7) between the rollers in such a manner that the teeth (11) of the rollers penetrate the batt (7) which is thus drawn to obtain a semifinished nonwoven product (8), the degree of drawing being such that over the whole thickness of the product (8) the majority of the discontinuous fibers are pivoted about the teeth (11) in such a manner that said first angle (A) is changed to a second angle (B) comprised between 30° and 60° to the longitudinal direction (Y) of the two symmetrical directions (E1; E2) of the majority of the discontinuous fibers in the drawn product (8); said second angle (B) being such as to obtain a predetermined resistance to pulling stress of the drawn product (8); and a width (L2) of the product (8) as measured perpendicular to the longitudinal direction (Y) is substantially equal to the corresponding width (L2) of the batt (7) before drawing;

means for feeding said semifinished intermediate product (8) to a spreading and lap-forming unit (13; 13A; 13B) which deposits the semifinished product (8) in alternate pleats on a delivery belt of the lap-forming unit, so as to form a lap (15) of superposed layers such that the majority of the discontinuous fibers in each layer are distributed in orientations (F1; F3) forming an angle (C) with the orientations (F2; F4) of the majority of the fibers in the contiguous layers; and means for subjecting the lap (15) subsequently to a fixing treatment in order to obtain a nonwoven product presenting four different orientations (F1; F2; F3; F4) of the majority of the discontinuous fibers.

8. An installation as claimed in claim 7, wherein said second angle (b) is about 45°.

9. An installation as claimed in claim 7, wherein said batt (7) is comprised of four layers of web.

10. An installation as claimed in claim 7, and means for subjecting the edges of said batt (7) to teasing.

11. An installation as claimed in claim 7, and means for coiling said semifinished woven product (8), and then means for uncoiling said semifinished unwoven product (11) prior to feeding the same to said lap forming unit (13; 13A; 13B).

12. An installation as claimed in claim 7, wherein said fixing treatment is needle punching.

* * * * *